US011605912B2

(12) United States Patent
Wu

(10) Patent No.: US 11,605,912 B2
(45) Date of Patent: Mar. 14, 2023

(54) TERMINAL BLOCK FOR CONNECTING A CIRCUIT BOARD AND WIRES WITH A SLIDABLE FASTENER ON THE BODY

(71) Applicants: DINKLE ENTERPRISE CO., LTD., New Taipei (TW); DINKLE ELECTRIC MACHINERY (CHINA) CO., LTD., Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN)

( * ) Notice: Subject to any disclaimer, the term of this patent is extended or adjusted under 35 U.S.C. 154(b) by 9 days.

(21) Appl. No.: 17/341,710

(22) Filed: Jun. 8, 2021

(65) Prior Publication Data

US 2022/0393378 A1 Dec. 8, 2022

(51) Int. Cl.

*H01R 12/72* (2011.01)
*H01R 13/502* (2006.01)
*H01R 12/70* (2011.01)

(52) U.S. Cl.

CPC ..... *H01R 12/721* (2013.01); *H01R 12/7023* (2013.01); *H01R 12/722* (2013.01); *H01R 13/502* (2013.01)

(58) Field of Classification Search

CPC ..... H01R 12/721; H01R 12/7023; H01R 12/722; H01R 13/502

(Continued)

(56) References Cited

U.S. PATENT DOCUMENTS 4,708,413 A * 11/1987 Schroeder ..... H01R 13/6272 439/352
5,120,255 A * 6/1992 Kouda ..... H01R 13/641 439/489

(Continued)

FOREIGN PATENT DOCUMENTS

CN 105098434 B * 2/2018
DE 102008026390 A1 12/2008

(Continued)

OTHER PUBLICATIONS

Office Action dated Apr. 13, 2022 of the corresponding German patent application No. 102021116851.1.

*Primary Examiner* — Peter G Leigh
(74) *Attorney, Agent, or Firm* — Chun-Ming Shih; HDLS IPR Services

(57) ABSTRACT

A terminal block includes an insulative seat, a flexible arm latch and a slider. The insulative seat has a slot and a sliding trough. A longitudinal direction of the sliding trough is parallel to a depth direction of the slot. The flexible arm latch is disposed on the insulative seat. A longitudinal direction of the flexible arm latch is parallel to the depth direction of the slot. The flexible arm latch has a first interfering portion and a hook. The slider is disposed in the sliding trough and longitudinally movable along the sliding trough. The slider has a second interfering portion. Either the first interfering portion or the second interfering portion is a slope. The first and second interfering portions abut against each other to push the slope to deflect the flexible arm latch to make the hook retract when the slider is traveling toward the slot.

6 Claims, 8 Drawing Sheets

(58) Field of Classification Search
USPC ..... 439/634
See application file for complete search history.

(56) References Cited

U.S. PATENT DOCUMENTS

| | | | | |
|---|---|---|---|---|
| 5,445,531 | A | 8/1995 | Billman et al. | |
| 5,507,666 | A * | 4/1996 | Yamanashi | H01R 13/641 439/354 |
| 5,643,003 | A * | 7/1997 | Myer | H01R 13/641 439/352 |
| 5,651,689 | A * | 7/1997 | Plyler | H01R 13/6272 439/352 |
| 5,720,623 | A * | 2/1998 | Polenick | H01R 13/641 439/352 |
| 5,738,543 | A * | 4/1998 | Rollins | H01R 13/4362 439/595 |
| 5,775,930 | A * | 7/1998 | Model | H01R 13/639 439/352 |
| 5,803,651 | A * | 9/1998 | Saito | H01R 13/641 439/352 |
| 5,807,130 | A * | 9/1998 | Miller | H01R 13/4364 439/352 |
| 6,261,116 | B1 * | 7/2001 | Ceru | H01R 13/6272 439/352 |
| 6,514,098 | B2 * | 2/2003 | Marpoe, Jr. | H01R 13/64 439/352 |
| 6,824,417 | B1 * | 11/2004 | Nimura | H01R 13/641 439/352 |
| 7,066,773 | B1 * | 6/2006 | Martin | H01R 13/4365 439/752 |
| 7,892,048 | B2 * | 2/2011 | Shi | H01R 13/4367 439/752 |
| 8,550,860 | B2 * | 10/2013 | Dick | H01R 13/4365 439/752 |
| 8,926,355 | B2 * | 1/2015 | Heil | H01R 13/641 439/352 |
| 9,362,676 | B2 * | 6/2016 | Puhl | H01R 13/6275 |
| 9,705,228 | B2 * | 7/2017 | Caldwell | H01R 13/6397 |
| 9,929,508 | B2 * | 3/2018 | Puhl | H01R 13/6666 |
| 10,355,414 | B1 * | 7/2019 | Alvarado | H01R 13/639 |
| 10,454,209 | B2 * | 10/2019 | Holub | H01R 13/6275 |
| 2013/0260590 | A1 * | 10/2013 | Hitchcock | H01R 13/6397 439/312 |
| 2017/0054244 | A1 * | 2/2017 | Caldwell | H01R 13/641 |

FOREIGN PATENT DOCUMENTS

| | | | | |
|---|---|---|---|---|
| DE | 102008011805 | A1 * | 9/2009 | H01R 12/721 |
| DE | 102008011805 | A1 | 9/2009 | |
| DE | 102011005544 | A1 * | 9/2012 | H01R 12/7023 |
| EP | 2096721 | A1 * | 9/2009 | H01R 12/721 |
| EP | 2096721 | B1 * | 9/2013 | H01R 12/721 |
| WO | WO-9913534 | A1 * | 3/1999 | H01R 13/4365 |

* cited by examiner

TERMINAL BLOCK FOR CONNECTING A CIRCUIT BOARD AND WIRES WITH A SLIDABLE FASTENER ON THE BODY

BACKGROUND

Technical Field

The disclosure relates to a terminal block, particularly to a terminal block that is easy to plug and unplug.

Related Art

A terminal block for connecting a circuit board and wires is provided with a slidable fastener on the body thereof. The fastener clamps an edge of the circuit board inserted in the terminal block. When the terminal block is removed, the fastener is slid to be separated from the edge of the circuit board first, and then the terminal block can be separated from the circuit board. However, the fastener and the body are not firmly secured, so the circuit board is unstable. Therefore, a hook is provided to hook the circuit board. However, in practical usage, the hook is hard to be ejected from the circuit board. This makes the connector difficult to be removed from the circuit board. Also, a user is not able to know if the circuit board is positioned or not when pushing the fastener to clamp the circuit board.

SUMMARY

The disclosure provides a terminal block that is easy to plug and unplug.

The disclosure provides a terminal block, which includes an insulative seat, a flexible arm latch and a slider. The insulative seat has a slot and a sliding trough. A longitudinal direction of the sliding trough is parallel to a depth direction of the slot. The flexible arm latch is disposed on the insulative seat. A longitudinal direction of the flexible arm latch is parallel to the depth direction of the slot. One side surface of the flexible arm latch is provided with a first interfering portion and a hook. The hook perpendicularly interferes with an extending plane of the slot. The slider is disposed in the sliding trough and longitudinally movable along the sliding trough. The slider has a second interfering portion for pushing the first interfering portion. At least one of the first interfering portion and the second interfering portion is a slope. The slope is aslant arranged corresponding to a longitudinal direction of the flexible arm latch. The first interfering portion and the second interfering portion abut against each other to push the slope to deflect the flexible arm latch to make the hook retract during the slider moving toward a bottom of the slot.

In the terminal block of the disclosure, the slider is extended with a handle, and an extending direction of the handle is opposite to an opening of the slot.

In the terminal block of the disclosure, the insulative seat includes multiple wiring holes, and each wiring hole is opened oppositely to the slot.

In the terminal block of the disclosure, the first interfering portion and the second interfering portion are a pair of slopes attached to each other.

In the terminal block of the disclosure, the slider is of a plate shape, and the slider is restricted between the insulative seat and the flexible arm latch.

In the terminal block of the disclosure, the slider is attached to another side surface of the flexible arm latch, a surface of the slider, which is attached to the flexible arm latch, is formed with a flange, and the second interfering portion is disposed on a side of the flange.

In the terminal block of the disclosure, a stopping portion, which is used to stop the slider from moving oppositely to an opening of the slot, is disposed in the sliding trough.

In the terminal block of the disclosure, the stopping portion includes a stopping surface for stopping the slider, and the stopping surface is arranged toward the opening of the slot.

The terminal block of the disclosure uses the flexible arm latch to perpendicularly fasten the circuit board to firmly fix the circuit board and uses the slider for the flexible arm latch easily being pushed to release the circuit board.

In view of this, the inventors have devoted themselves to the above-mentioned related art, researched intensively and cooperated with the application of science to try to solve the above-mentioned problems. Finally, the invention which is reasonable and effective to overcome the above drawbacks is provided.

DETAILED DESCRIPTION

Figure 1:
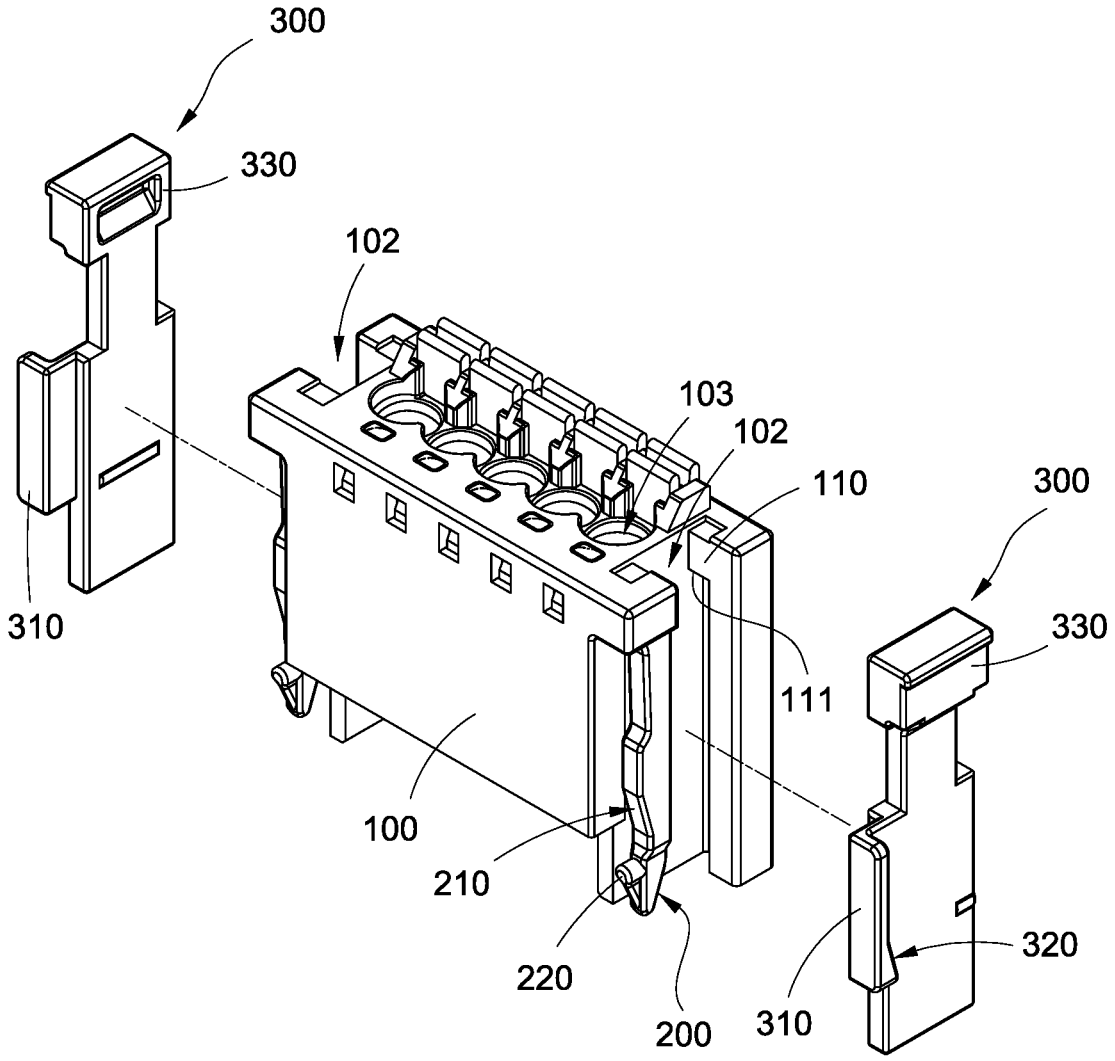
FIGS. 1 and 2 are exploded views of the terminal block of the disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIGS. 1-4. The disclosure provides a terminal block, which includes an insulative seat 100, at least one flexible arm latch 200 and a slider 300 corresponding to the flexible arm latch 200. In the embodiment, the terminal block includes a pair of flexible arm latches 200 and a pair of sliders 300 correspondingly. However, the disclosure does not limit the amount of the flexible arm latch 200 and the slider 300.

In the embodiment, the insulative seat 100 is of a flat rectangular block. The insulative seat 100 has a slot 101, at least one sliding trough 102 corresponding to the slider 300 and multiple wiring holes 103. An opening of the slot 101 is of a narrow-gap (or slit) shape and the inside of the slot 101 is formed with a flat space. In the embodiment, the insulative seat 100 has a pair of sliding troughs 102 corresponding to the pair of sliders 300. However, the disclosure does not limit the number of the sliding troughs 102. A longitudinal direction of the sliding trough 102 is parallel to a depth direction of the slot 101. Each wiring hole 103 is opened oppositely to the slot 101. The slot 101 is used for inserting a circuit board 10. Each wiring hole 103 is used for inserting a wire. In the embodiment, multiple terminals (not shown) are disposed in the insulative seat 100. The terminals extend between the slot 101 and the wiring holes 103 for electrically connecting the circuit board 10 to the wires.

The flexible arm latch 200 is fixed on the insulative seat 100 for fastening the circuit board 10. In the embodiment, the flexible arm latch 200 is formed with the insulative seat 100 into one piece and extended from the insulative seat 100. A longitudinal direction of the flexible arm latch 200 is parallel to the depth direction of the slot 101. A cross-section of the flexible arm latch 200 is substantially of a rectangular shape. A side surface of the flexible arm latch 200 is provided with a first interfering portion 210 and a hook 220. The hook 220 perpendicularly interferes with an extending plane of the slot 101. As a result, when the circuit board 10 is inserted into the slot 101, the hook 220 may snap at a fastening hole 11 of the circuit board 10 correspondingly to lock the circuit board 10. In the process of inserting the circuit board 10 into the slot 101, the circuit board 10 pushes the hook 220 to deflect the flexible arm latch 200 for flexible deformation. When the hook 220 snaps at the circuit board 10, the flexible arm latch 200 flexibly restores to cause vibration so as to make a user be aware of that the circuit board 10 is positioned. Also, the circuit board 10 is pressed by the flexible arm latch 200 to avoid an unstable state.

The slider 300 passes through the sliding trough 102 and is restricted between the insulative seat 100 and the flexible arm latch 200 to be longitudinally movable along the sliding trough 102. In the embodiment, the slider 300 is of a plate shape. Two edges of the slider 300 are restricted by the sliding trough 102 and two surfaces of the slider 300 are respectively restricted by the insulative seat 100 and the flexible arm latch 200. In detail, the slider 300 is attached to another side surface of the flexible arm latch 200. The slider 300 has a second interfering portion 320. In detail, a surface of the slider 300, which is attached to the flexible arm latch 200, is formed with a flange 311. A side of the second interfering portion 320, which is disposed on the flange 311, may interfere with the first interfering portion 210.

Please refer to FIGS. 5-8. In the embodiment, at least one of the first interfering portion 210 and the second interfering portion 320 is a slope, the other one may be any structure abutting against the slope, and the slope is aslant arranged corresponding to a longitudinal direction of the flexible arm latch 200. When the slider 300 is traveling toward the bottom of the slot 101, the first interfering portion 210 and the second interfering portion 320 abut against each other to convert the longitudinal displacement of the slider 300 relative to the flexible arm latch 200 into the transversal displacement of the flexible arm latch 200. Also, the degree of freedom of the slider 300 along a transversal direction of the flexible arm latch 200 is fixed by the sliding trough 102, the insulative seat 100 and the flexible arm latch 200, so all relative transversal displacements between the slider 300 and the flexible arm latch 200 are located at the flexible arm latch 200 so as to deflect the flexible arm latch 200 to make the hook 220 retract from the circuit board 10.

In the embodiment, the first interfering portion 210 and the second interfering portion 320 are a pair of slopes attached to each other so as to make the action of the displacement conversion be stable, but not limited to this.

Figure 4:
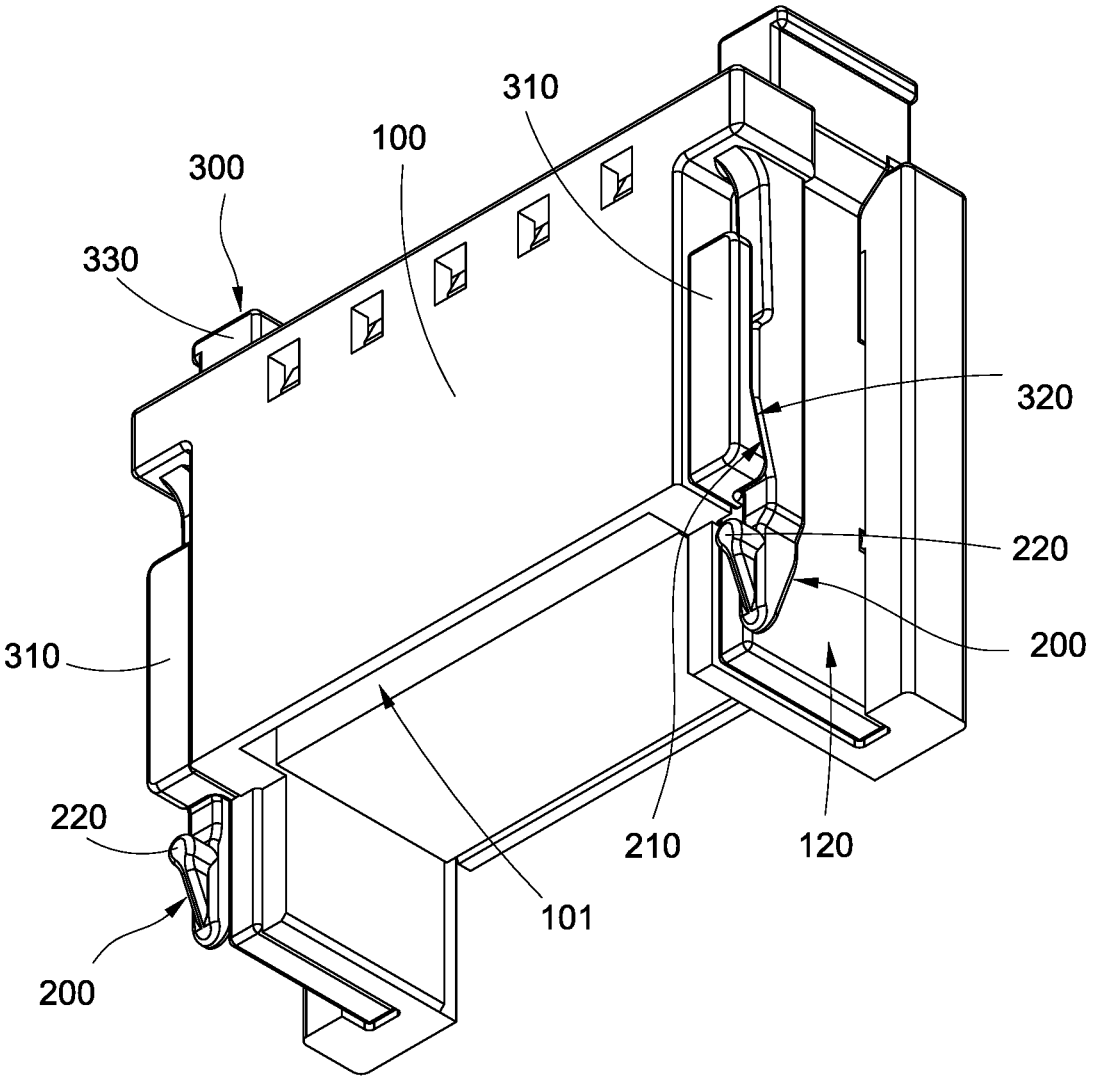
Figure 5:
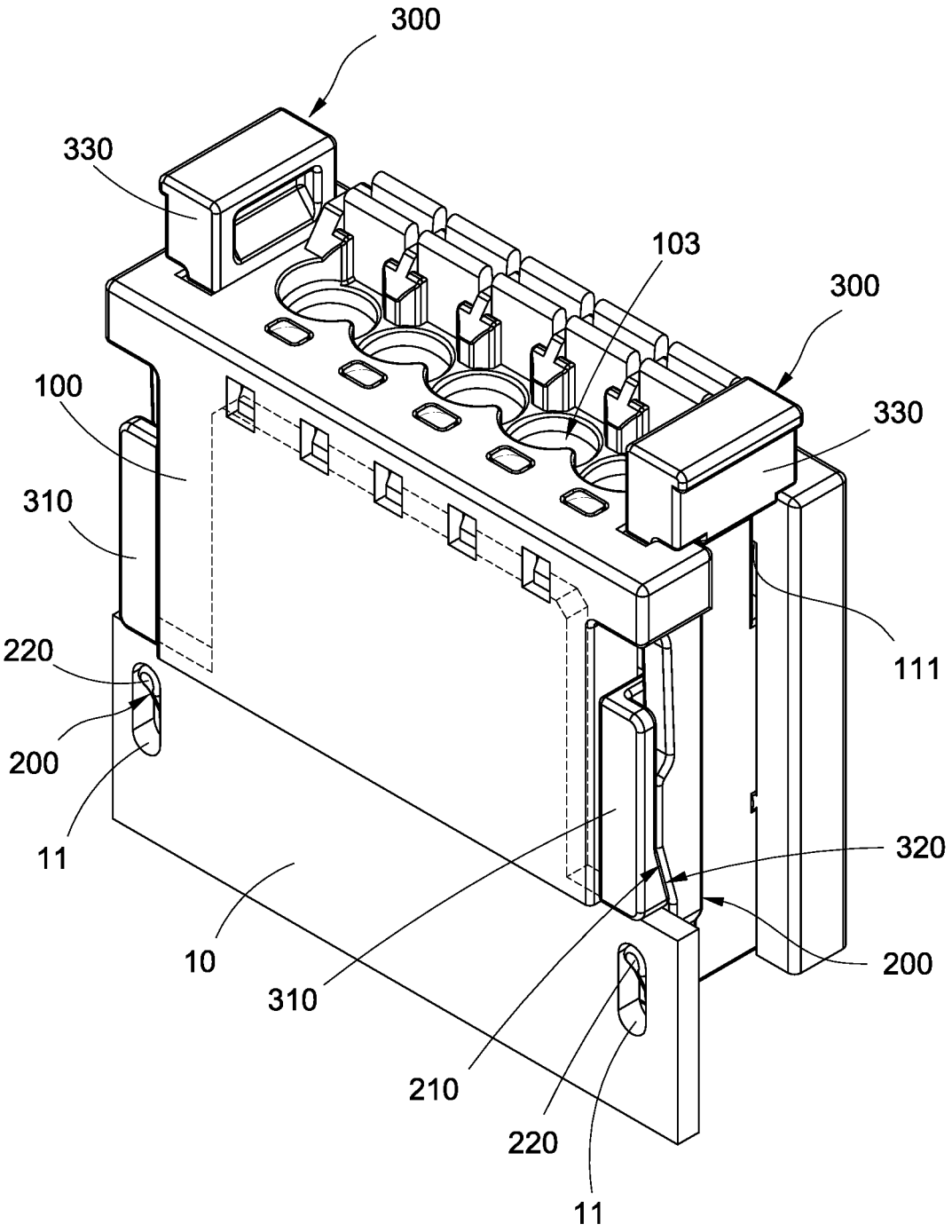
FIGS. 5 to 8 are schematic views of the terminal block of the disclosure in use.

Please refer to FIGS. 4-8. The slider 300 is extended with a handle 330. The extending direction of the handle 330 is opposite to the opening of the slot 101. In other words, as shown in FIG. 4, the slot 101 is opened downward and the handle 330 is extended upward. Thus, the user may pull the handle 330 to pluck the terminal block.

Figure 2:
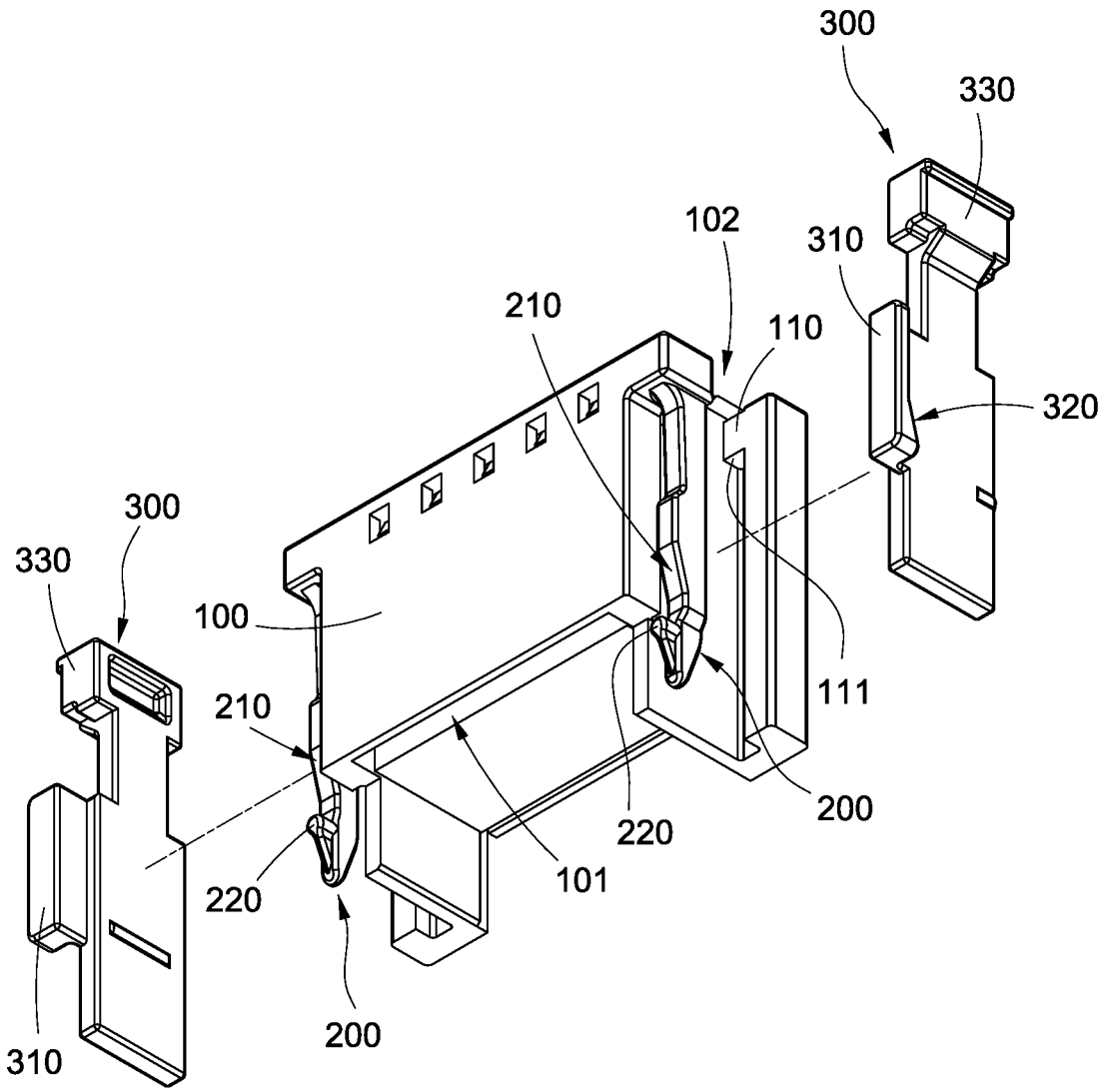
Figure 3:
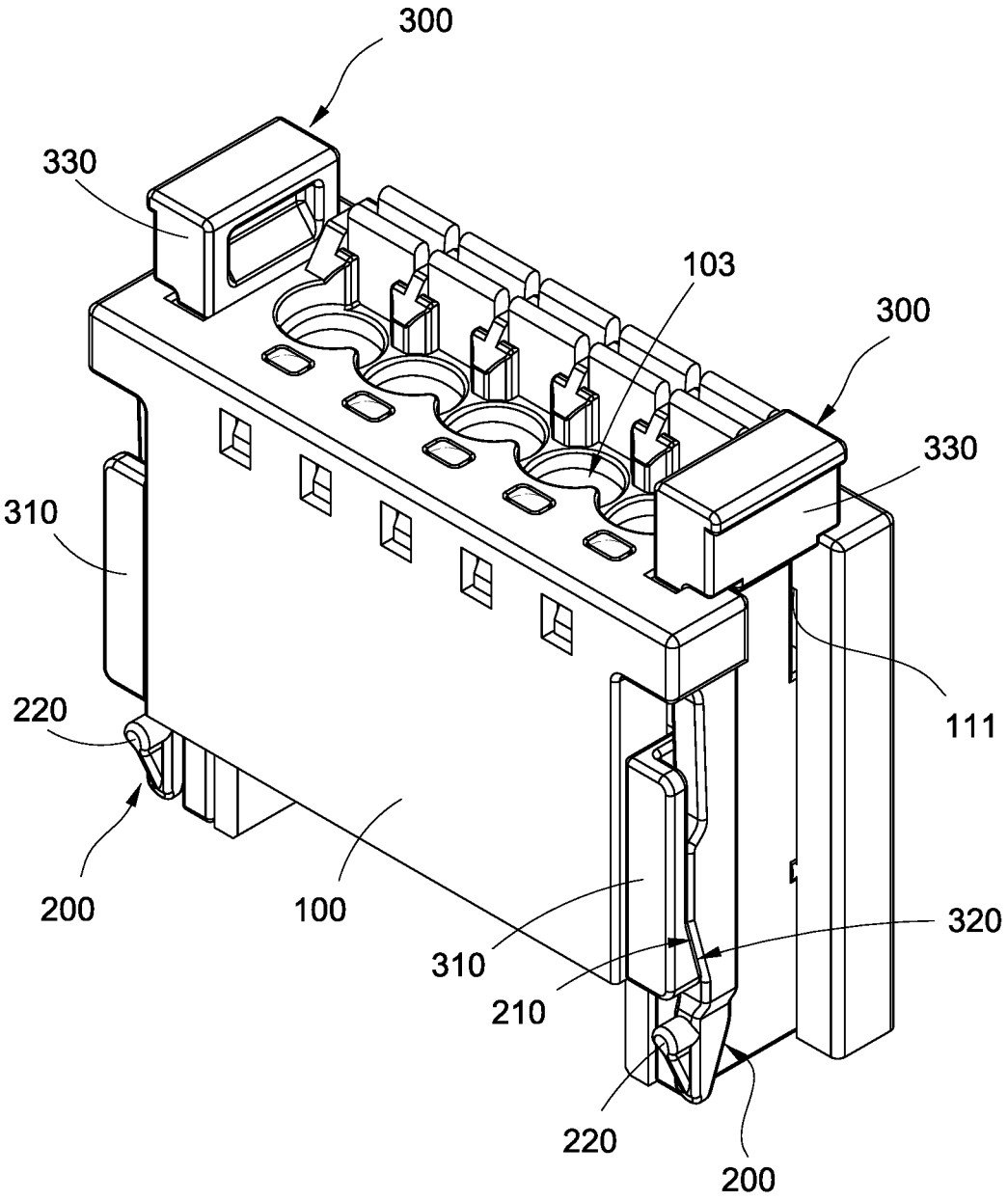
FIGS. 3 and 4 are perspective views of the terminal block of the disclosure.

A stopping portion 110, which is used to stop the slider 300 from moving oppositely to the opening of the slot 101, is disposed in the sliding trough 102. In other words, as shown in FIG. 2, the slot 101 is opened downward and the stopping portion 110 stops the slider 300 from moving upward. In the embodiment, the stopping portion 110 has a stopping surface 111 for stopping the slider 300. The stopping surface 111 is arranged toward the opening of the slot 101.

The moving direction when the slider 300 releases the flexible arm latch 200 matches the extending direction of the handle 330 and is opposite to the opening of the slot 101. After the flexible arm latch 200 is pushed away from the circuit board by the slider 300, the user may continue to pull the handle 330 until the slider 300 moves to abut against the stopping surface 111, so that the insulative seat 100 may be further pulled to be separated from the circuit board 10. As a result, the circuit board 10 may be released and removed simultaneously from the circuit board 10 as long as the user pulls the handle 330.

Figure 6:
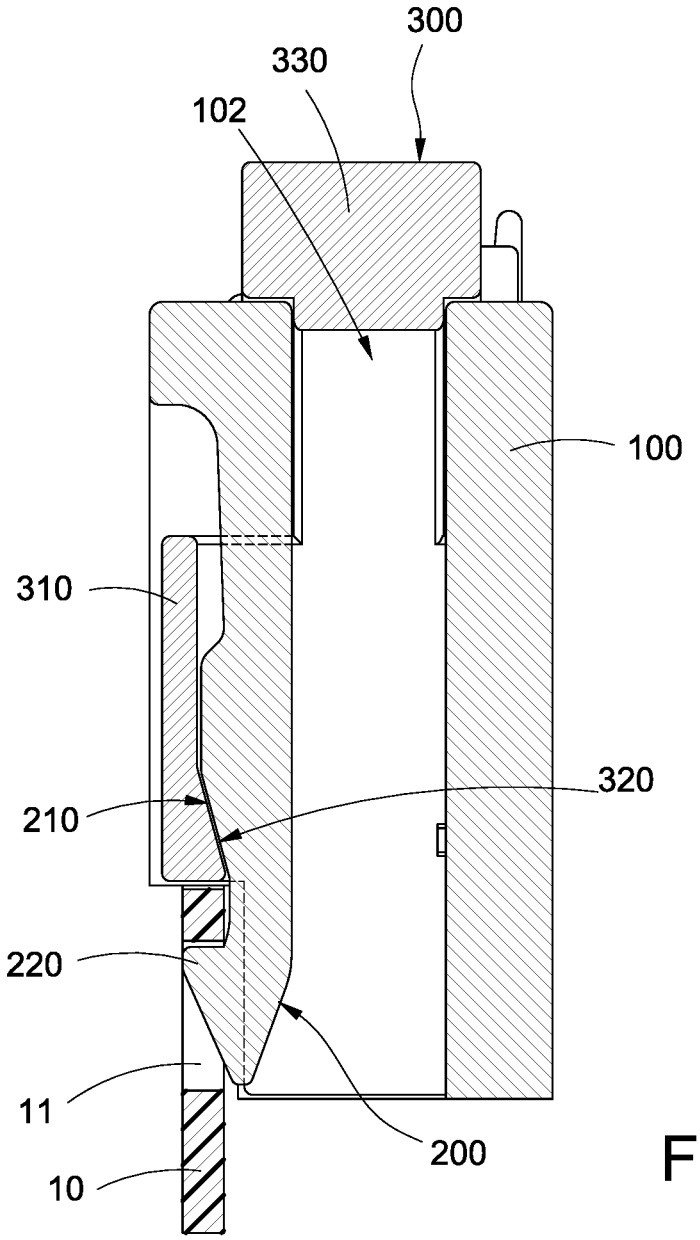
Figure 7:
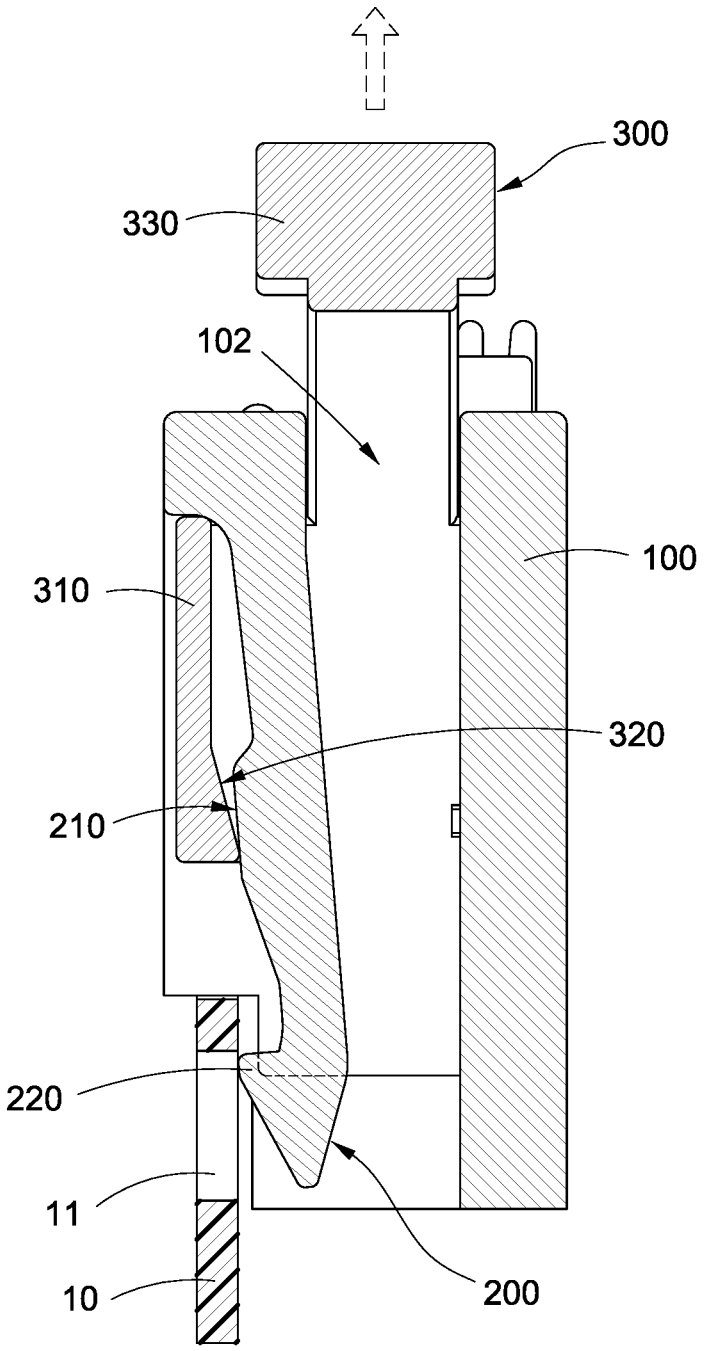
Figure 8:
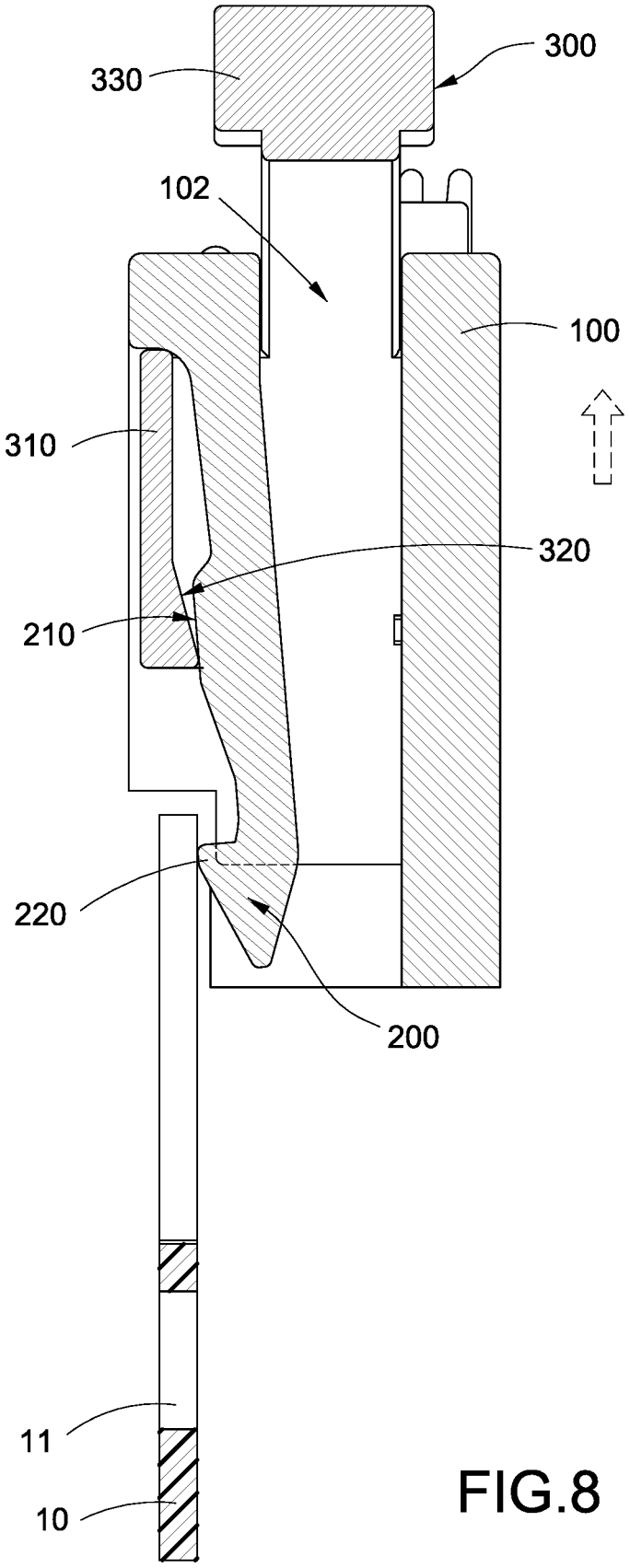

As shown in FIG. 6, when the hook 220 of the flexible arm latch 200 snaps at the fastening hole 11 of the circuit board 10, the slider 300 abuts against an edge of the circuit board 10 to further fix the circuit board 10 by the hook 220 and the slider 300. In the embodiment, the circuit board 10 is clamped by the hook 220 of the flexible arm latch 200 and the flange 311 of the slider 300 so as to position the circuit board 10 along the depth direction of the slot 101, but not limited to this.

While this disclosure has been described by means of specific embodiments, numerous modifications and variations could be made thereto by those skilled in the art without departing from the scope and spirit of this disclosure set forth in the claims.

What is claimed is:

1. A terminal block comprising:

an insulative seat, comprising a slot and a sliding trough, and a longitudinal direction of the sliding trough being parallel to a depth direction of the slot;

a flexible arm latch, disposed on the insulative seat, a longitudinal direction of the flexible arm latch being parallel to the depth direction of the slot, a first interfering portion and a hook are disposed on one side surface of the flexible arm latch, and the hook perpendicularly interfering with an extending plane of the slot; and a slider, disposed in the sliding trough, longitudinally movable along the sliding trough, and comprising a second interfering portion pushing the first interfering portion;

wherein at least one of the first interfering portion and the second interfering portion is a slope, the slope is aslant arranged corresponding to the longitudinal direction of the flexible arm latch, and the first interfering portion and the second interfering portion abut against each other to push the slope to deflect the flexible arm latch to make the hook retract during the slider moving toward a bottom of the slot, wherein a stopping portion is disposed in the sliding trough, the stopping portion stops the slider from moving oppositely to an opening of the slot;

wherein the stopping portion comprises a stopping surface stopping the slider, and the stopping surface is arranged toward the opening of the slot.

2. The terminal block of claim 1, wherein the slider is extended with a handle, and an extending direction of the handle is opposite to an opening of the slot.

3. The terminal block of claim 1, wherein the insulative seat comprises multiple wiring holes, and each wiring hole is opened oppositely to the slot.

4. The terminal block of claim 1, wherein the first interfering portion and the second interfering portion are a pair of slopes attached to each other.

5. The terminal block of claim 1, wherein the slider is of a plate shape, and the slider is restricted between the insulative seat and the flexible arm latch.

6. The terminal block of claim 1, wherein the slider is attached to another side surface of the flexible arm latch, a flange is disposed convexly on a surface of the slider attached to the flexible arm latch, and the second interfering portion is disposed on a side of the flange.

* * * * *